United States Patent [19]

Niedecker

[11] Patent Number: 4,561,583

[45] Date of Patent: Dec. 31, 1985

[54] APPARATUS FOR CLOSING TUBULAR WRAPPERS

[76] Inventor: Herbert Niedecker, Am Ellerhang 6, D 6240 Königstein 2, Fed. Rep. of Germany

[21] Appl. No.: 605,011

[22] Filed: Apr. 27, 1984

[30] Foreign Application Priority Data

May 6, 1983 [DE] Fed. Rep. of Germany ..... 3316587

[51] Int. Cl.[4] ..... B25C 7/26

[52] U.S. Cl. ..... 227/109; 53/138 A

[58] Field of Search ..... 53/138 A; 227/109, 120, 227/130

[56] References Cited

U.S. PATENT DOCUMENTS

| | | | |
|---|---|---|---|
| 4,186,862 | 2/1980 | Klaus | 227/130 |
| 4,341,336 | 7/1982 | Smith | 227/130 X |
| 4,404,894 | 9/1983 | Oesterle | 227/130 X |

FOREIGN PATENT DOCUMENTS 2647598 4/1978 Fed. Rep. of Germany .

*Primary Examiner*—Paul A. Bell

*Attorney, Agent, or Firm*—Sprung Horn Kramer & Woods

[57] ABSTRACT

In apparatus for closing tubular wrappers with U-shaped closing clips, which are individually supplied to a clip-guiding passage 3, particularly in such apparatus having a vertical working stroke, it is desired to permit the use of such apparatus not only for processing closing clips 6 which have a profile width conforming to the inside width of the clip-guiding passage 3 but also for processing closing clips 8 having a smaller profile width. This object is accomplished in that such closing machines are provided with a driver 2 having a shank 4 which is tapered in thickness toward the forward end face 5 of the driver on that longitudinal side which faces the clip-feeding passage 7 so that the thickness of the driver 2 at its forward end face 5 does not exceed 85% of the full thickness of the shank 4. FIG. 2.

2 Claims, 2 Drawing Figures

APPARATUS FOR CLOSING TUBULAR WRAPPERS

Figure 1:
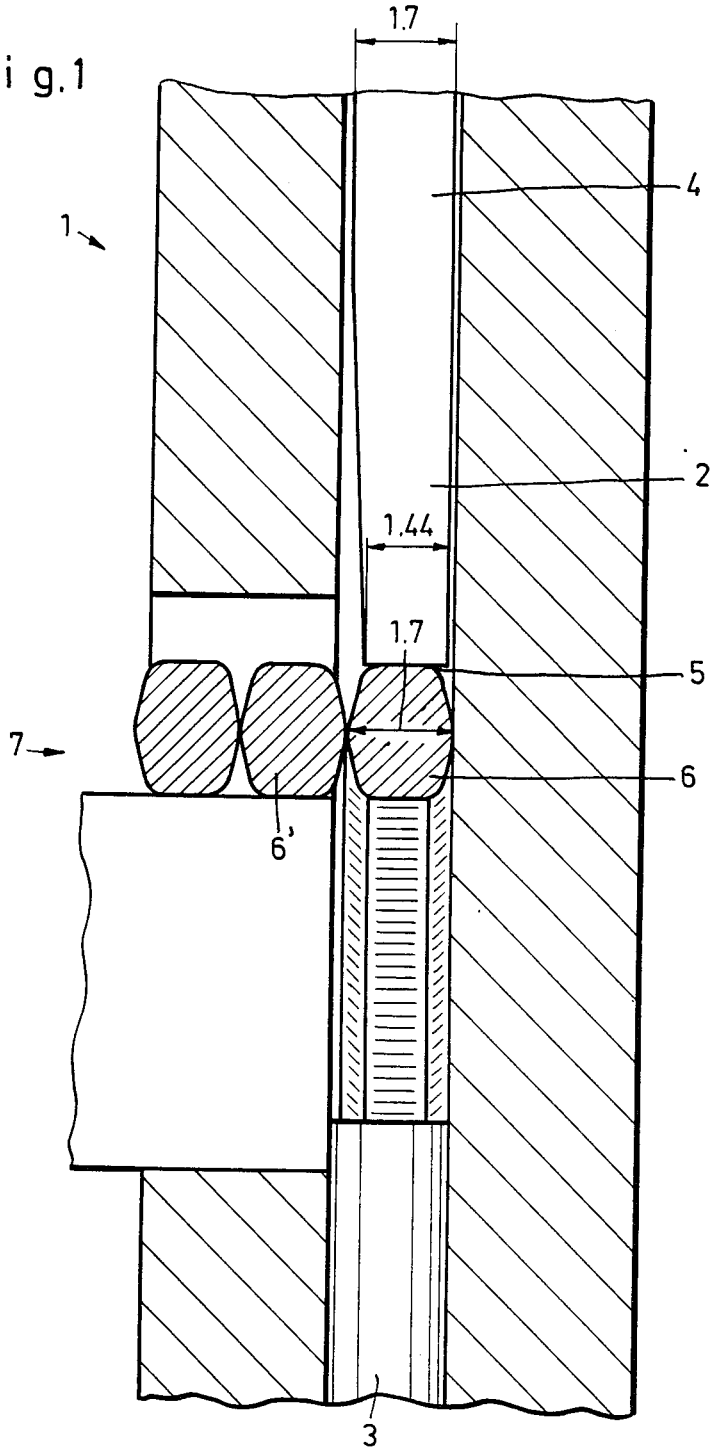

This invention relates to apparatus for closing tubular wrappers with U-shaped closing clips, which are individually supplied through a magazine to a clip-guiding passage, in which each clip is engaged by the forward end face of a generally rectangular driver, which generally conforms in cross-section to the clip-guiding passage and is actuated to move said clip onto a die. In such apparatus the punch has previously been designed to fully engage with its forward end face each closing clip which is being moved by the driver onto the die. For this purpose the thickness of the shank of the driver agrees approximately to the inside width of the clip-guiding passage. Only on that longitudinal side which faces the clip-feeding passage is the shank of the punch formed with a slight chamfer so that the next following clip coming from the magazine will not be engaged and damaged by the forward end face of the driver. By that chamfer the thickness of the shank of the driver is reduced by about 5%.

The known closing apparatus described hereinbefore, particularly such apparatus having a vertical working stroke and having a clip-guiding passage which has given dimensions, can be used to process only clips which in their profile width conform to the clip-guiding passage. For this reason, closing machines having clip-guiding passages in different sizes and having correspondingly different closing tools must be used to process different clips having different profile widths selected in view of the requirements to be met by the closure of a given wrapper. Owing to this fact there is a requirement in practice, particularly in connection with apparatus having a vertical working stroke, to provide a single closing machine which is capable of processing also clips having a somewhat smaller profile width without a need to change the components which depend on the dimensions of the clip, i.e., the clip-guiding passage, driver, and die. That requirement will particularly arise if the profile widths of two different clip sizes differ by 10 to 20% so that the difference in profile width greatly exceeds the dimensional tolerance of the material.

This object is accomplished in accordance with the invention in that the driver used in the closing machines is so designed that closing clips having a profile width that is smaller than the inside width of the clip-guiding passage can also be actuated by that punch in such a manner that the next following clip will not be engaged and possibly damaged by such driver. For this purpose the shank of the driver tapers in thickness toward the forward end face of the driver on that longitudinal side which faces the clip-feeding passage so that the thickness of the driver at its forward end face does not exceed 85% of the full thickness of the shank of the driver.

From a slightly chamfered driver, which cannot be used with clips having a smaller profile width without damaging the next following clip, the punch in accordance with the invention differs in that the thickness of the driver at its forward end face is reduced to a larger extent. A reduction by 25% or more appears to be impracticable because a reliable guidance of the clip in the clip-guiding passage would no longer be ensured in that case.

German Patent Specification No. 26 47 598 discloses closing apparatus which has a horizontal working stroke and in which closing clips are used which have a profile width that is smaller than the inside width of the clip-guiding passage, but in the operation disclosed there the driver would also engage the next following clip.

The advantage afforded by the driver designed in accordance with the invention resides in that closing clips having different profile widths can be processed by a closing machine without a need for an alteration of the closing machine. As a result, the user can use thicker clips or more economical, thinner clips, in dependence on the requirements imposed by the packaging.

Figure 2:
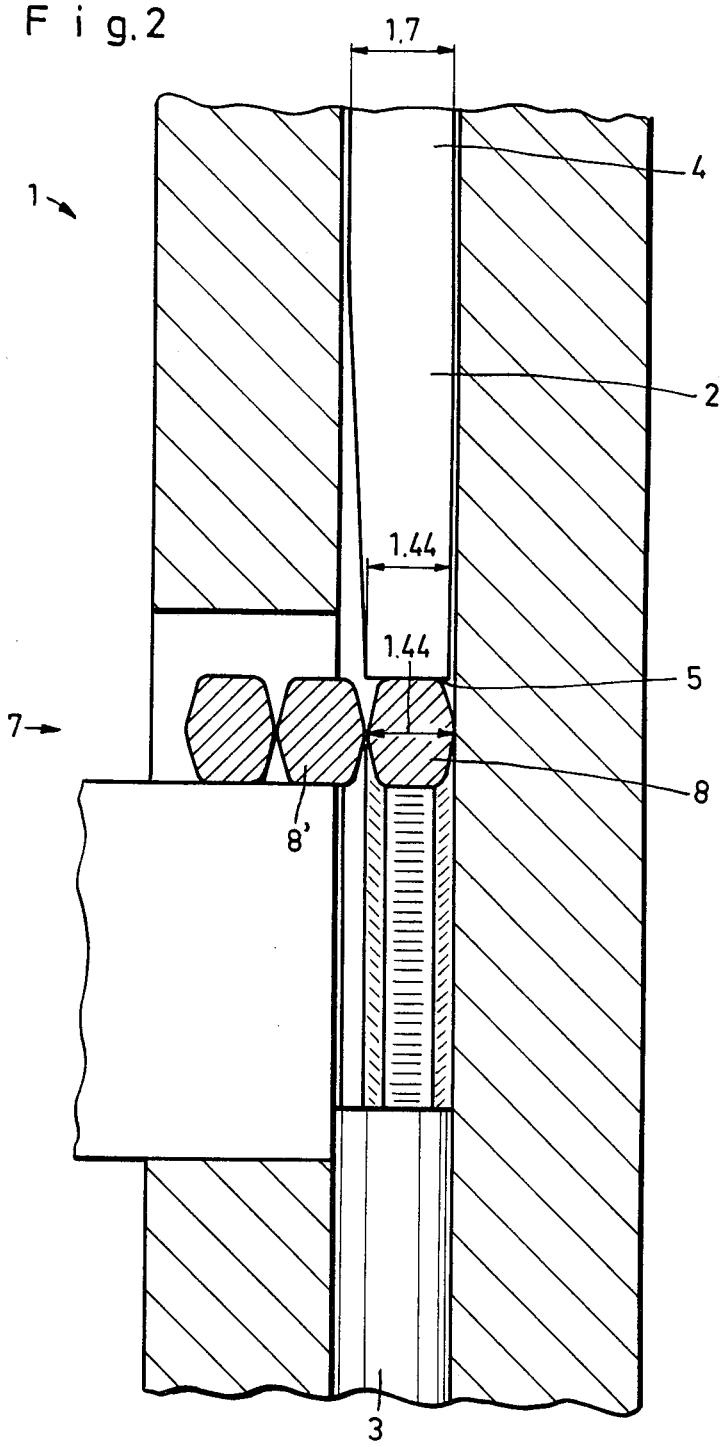

The invention will now be described with reference to the drawings:

FIGS. 1 and 2 are similar sectional views showing the clip-actuating means of apparatus which has a vertical working stroke and serves to close tubular wrappers with clips having different profile widths. The dimensions indicated are those of a practical embodiment.

FIG. 1 shows clip-actuating means 1 comprising a driver 2, which is movable in a clip-guiding passages 3. The shank 4 of the driver 2 has a thickness of 1.7 mm, which corresponds to the inside width of the clip-guiding passage 3. That inside width has been selected for closing clips having a profile width of 1.7 mm. On that longitudinal side which faces the clip-feeding passage 7 the shank 4 of the driver 2 is tapered so that the driver has at its end face a width of 1.44 mm, which is approximately 85% of the full thickness of the shank 4. With its forward end face 5, the driver 2 adequately engages the top of the crosspiece of the U-shaped closing clip 6 and reliably moves that clip to the closing station, not shown. After the driver 2 has performed a return stroke, the next following U-shaped closing clip 6' is pushed to the position illustrated for the U-shaped closing clip 6 under the action of the weight of the closing clips contained in the magazine or under the action of additional weights.

FIG. 2 shows the same arrangement as FIG. 1 with the same dimensions. The U-shaped closing clip 8 used in this case has a profile width of only 1.44 mm rather than 1.7 mm. Whereas the forward end face 5 of the driver 2 protrudes beyond the top of the cross-piece of the closing clip, the forward end face 5 will not damage the next following U-shaped closing clip 8', which during the working stroke of the driver 2 is pushed back into the clip-feeding passage 7 by the shank 4, which is tapered in thickness on its longitudinal side facing the clip-feeding passage. When the driver 2 has completed its return stroke, that next following clip 8' is moved to the position illustrated for the closing clip 8 under its own weight or under the action of additional weights.

What is claimed is:

1. In an apparatus for closing U-shaped closing clips about the mouth of a tubular wrapper, the apparatus including a clip passage to which the clips are guided after being supplied through a magazine, a reciprocable driver having a generally rectangular shank which generally conforms in cross-section to the clip-guiding passage, and a closing die, advance of said driver moving a clip from said magazine through said passage and against said die, the improvement wherein the shank of said driver is tapered in thickness toward its end face on that longitudinal side which faces the clip-guiding passage, the thickness of the driver being about 75 to 85% of the full thickness of the shank, whereby the apparatus can operate upon clips of different widths.

2. An apparatus according to claim 1, wherein the thickness of the face of the driver is about 85% of the maximum thickness of the shank of the driver.

* * * * *